US005171011A

United States Patent [19]

Squadroni

[11] Patent Number: 5,171,011

[45] Date of Patent: Dec. 15, 1992

[54] HANDLE WITH A PNEUMATIC SURFACE CAPABLE OF BEING DEFORMED

[76] Inventor: Elpidio O. Squadroni, Via Vela 99, 60012 Civitanova Marche/MC, Italy

[21] Appl. No.: 769,939

[22] Filed: Sep. 30, 1991

[30] Foreign Application Priority Data

Oct. 17, 1990 [IT] Italy ..... 17966 A/90

[51] Int. Cl.[5] ..... A63B 49/08

[52] U.S. Cl. ..... 273/73 J; 273/67 R; 273/75; 273/81 R

[58] Field of Search ..... 273/67 R, 738, 75, 81 R

[56] References Cited

U.S. PATENT DOCUMENTS

| | | | |
|---|---|---|---|
| 4,407,500 | 10/1983 | Hofmann | 273/73 X |
| 4,804,183 | 2/1989 | Doran et al. | 273/75 X |
| 4,907,810 | 3/1990 | Whiteford | 273/73 X |
| 5,042,804 | 8/1991 | Uke et al. | 273/75 |

FOREIGN PATENT DOCUMENTS

| | | | |
|---|---|---|---|
| 3912174 | 10/1989 | Fed. Rep. of Germany | 273/73 X |
| 2213736 | 8/1989 | United Kingdom | 273/73 R |
| 2230458 | 10/1990 | United Kingdom | 273/73 X |

*Primary Examiner*—Vincent Millin
*Assistant Examiner*—Raleigh W. Chiu
*Attorney, Agent, or Firm*—Eckert Seamans Cherin & Mellott

[57] ABSTRACT

A handle for an object such as a tool or racket includes a hollow element having a wall and a plurality of openings in the wall. The openings may have different shapes and dimensions. An air tube inside the hollow element is inflatable through a valve which is accessible from outside the hollow element. After being inflated, portions of the air tube protrude through the openings, thereby forming a plurality of pads capable of being deformed. Inside the air tube, a bar equipped with a movable mass provides adjustable balancing for the handle.

22 Claims, 4 Drawing Sheets

HANDLE WITH A PNEUMATIC SURFACE CAPABLE OF BEING DEFORMED

SUMMARY OF THE INVENTION

1. Field of the Invention

The present invention refers to a handle or handgrip for an object such as a tool or racket, the handle having elements capable of being deformed.

2. Background Information

Different solutions are known to realize handles for sports equipment, such as rackets for tennis, table-tennis, golf, handlebars in general, tools, car steering wheels, etc. equipped with means capable of being deformed, that allow a strong and comfortable grip.

However, these traditional means, though realized with materials capable of being deformed, with different mechanical properties, do not prevent users from possible distortions, callosities, dislocations, etc.

SUMMARY OF THE INVENTION

Purpose of the present invention is to provide a handle or handgrip that supplies users with a comfortable and safe grip, reducing the risks of bony or skin injuries to a minimum.

These and other purposes are obtained by the handle according to the invention including a rigid or semi-rigid hollow element, wherein on the surface of said hollow element there are some openings and in that, inside said hollow element, an air tube is provided, which can be inflated through a valve that can be accessed from the outside, which partially protrudes from the hollow element surface through the above-said openings under the internal air pressure, realizing a series of pads of variable measures depending on the air pressure into the tube.

Further properties and advantages of the invention will better appear from the description of a preferred, but not exclusive, embodiment of the device shown as a not limiting example in the enclosed drawings.

DESCRIPTION OF THE PREFERRED EMBODIMENT

Figure 1:
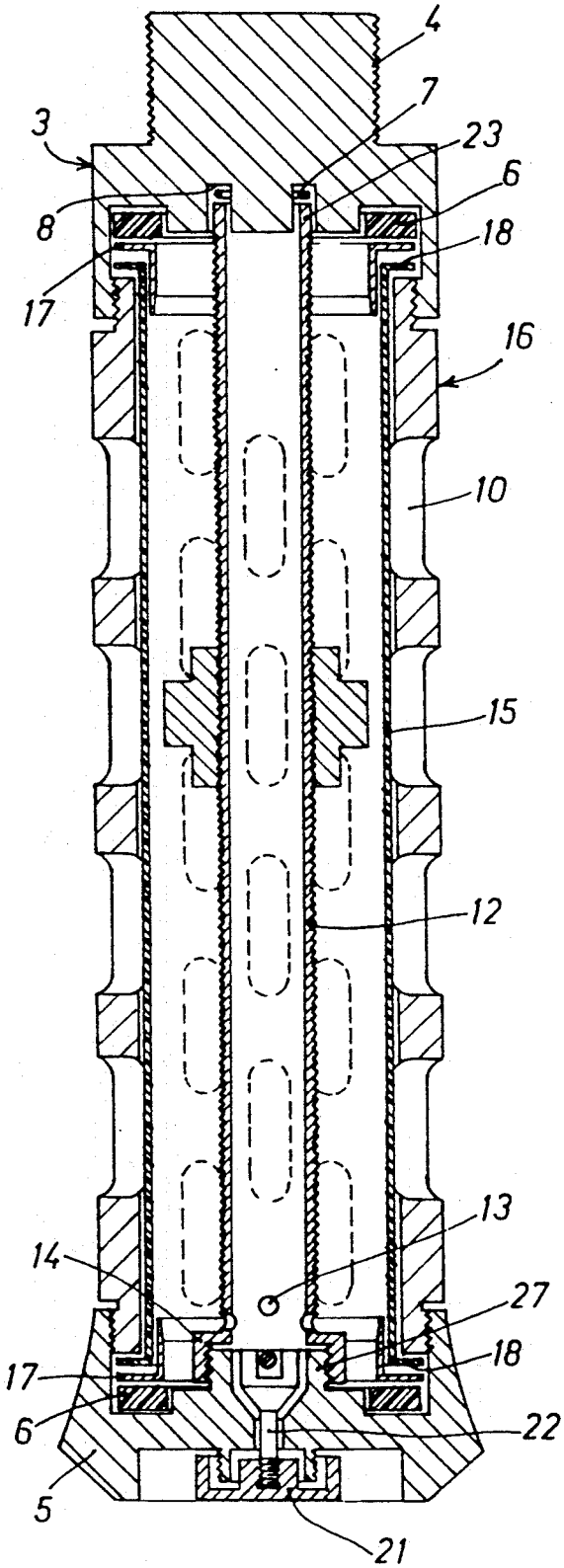
FIG. 1 is a longitudinal section of the handle.
Figure 2:
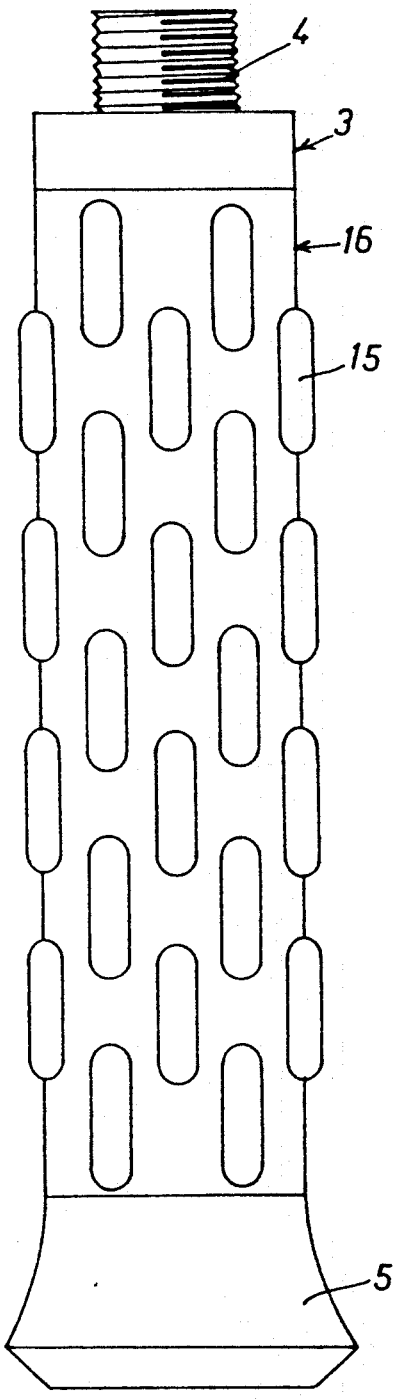
FIG. 2 is a plan view of the handle.
Figure 3:
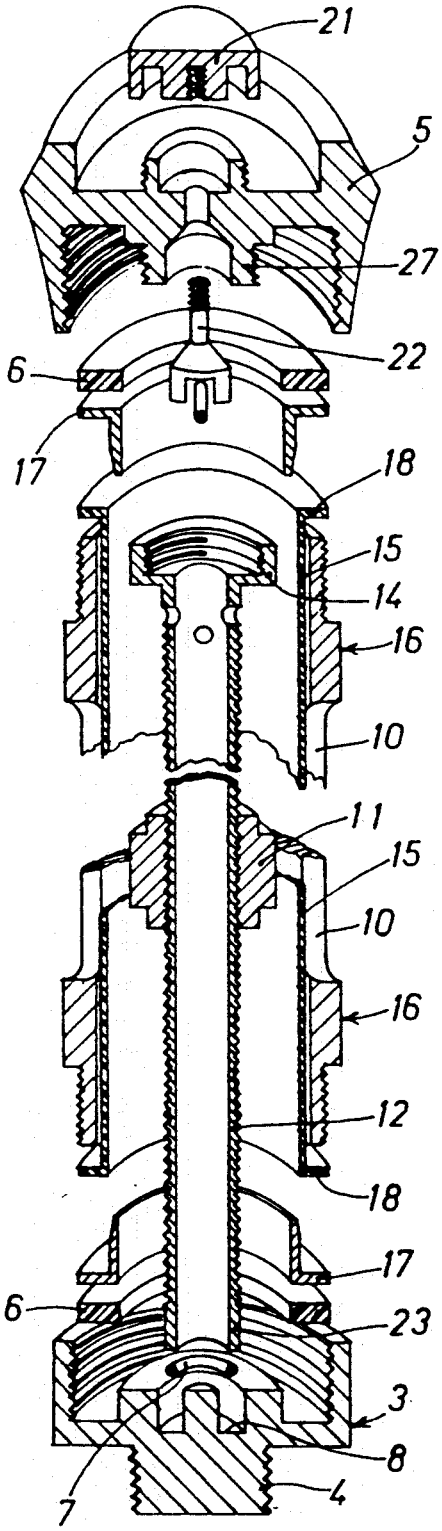
FIG. 3 is an exploded section of the parts composing the handle.
Figure 4:
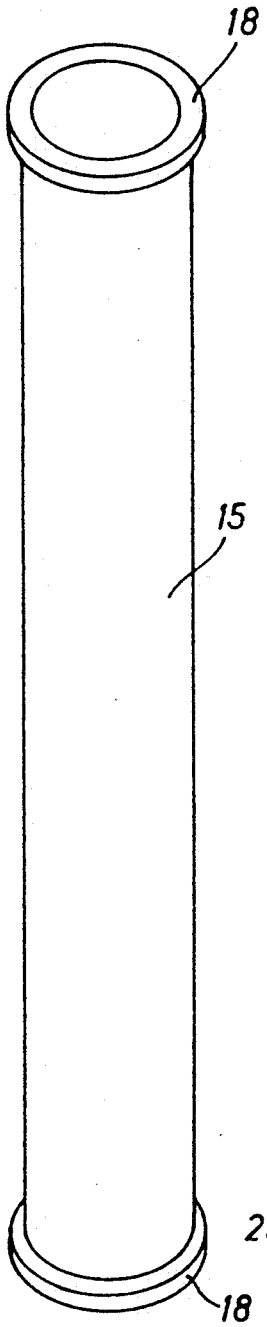
FIG. 4 is a perspective view of the air tube.
Figure 5:
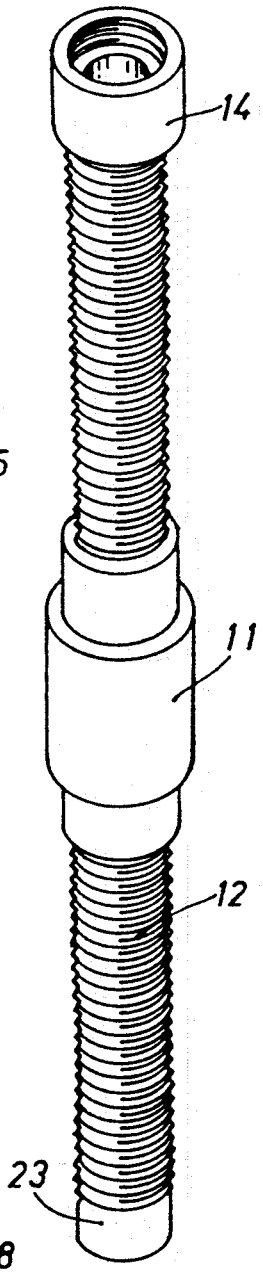
FIG. 5 is a perspective view of the balancing bar.

With reference to FIG. 1, the handle is composed of a hollow cylinder 16 having opposite threaded end and a plurality of openings 10 extending through a wall of the hollow cylinder 16. Disposed within the cylinder 16 is a cylindrical air tube 15 that is open at its two opposite ends, said air tube having at its ends an external raised edge 18 to allow its anchorage to the cylinder 16.

An internally threaded plug 3 equipped with an external extension 4, externally threaded, suitable to be screwed to the tool or the fixture of which the hollow cylinder 16 is the handle is provided assembled at one end of the cylinder 16. A second internally threaded plug 5 closes the opposite end of the cylinder 16.

Inside said plug 5 a valve 22 is provided, covered by a cap 21, screwed into the plug 5, suitable to provide an air inlet into air tube 15.

Inside plug 5, an externally threaded cylindrical extension 27 threadedly attaches to end 14 of hollow balancing bar 12. A hole 13 in the hollow balancing bar 12 enables air to flow from the inflating valve 22 to an interior of the air tube 15.

The opposite end 23 of the balancing bar 12 is engaged, by interposing a sealing ring 7, into a groove 8 present on the bottom of the plug 3.

Circular inserts 17 and sealing rings 6 are interposed provided interposed between the plugs 3 and 5 and the cylinder 16, in order to strongly clamp the edges 18 of the air tube 15 between the end edge of the cylinder 16 and said plugs 3 and 5.

Figure 6:
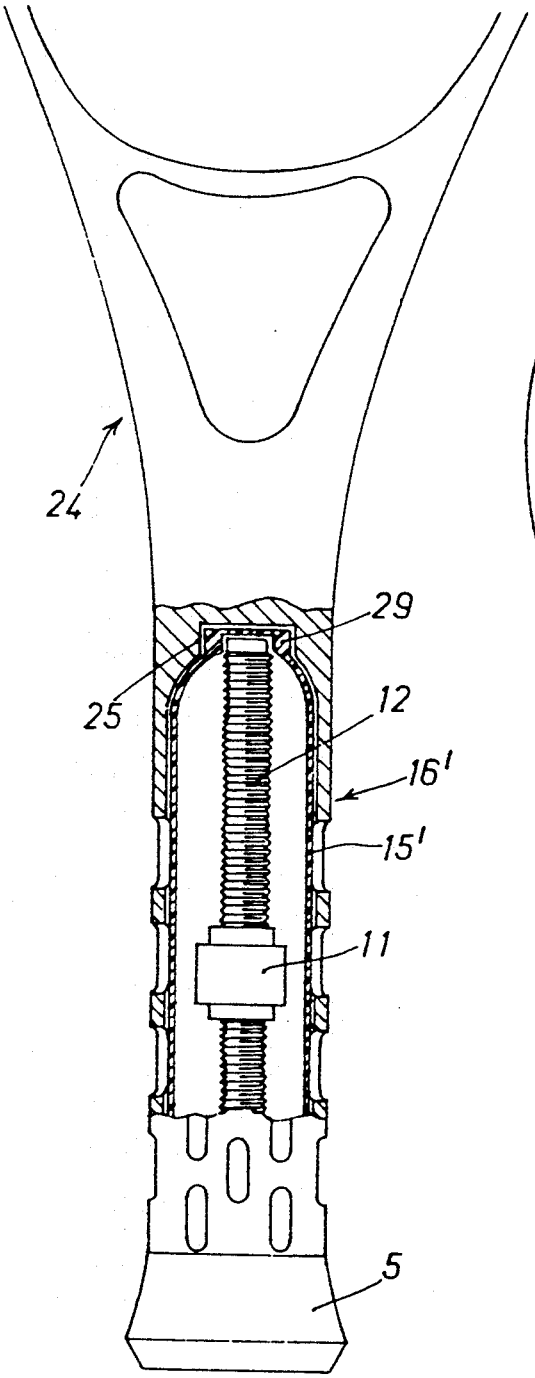
FIG. 6 is a section of the handle assembled on a partially shown tennis racket.
Figure 7:
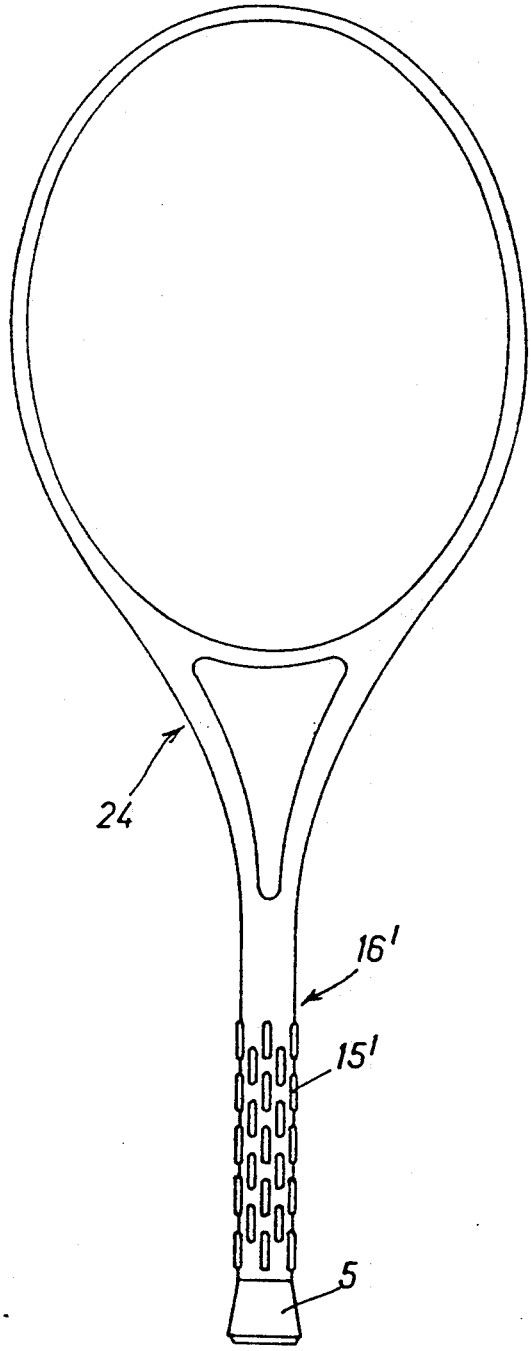
FIG. 7 is a plan view of a tennis racket on which the handle is assembled.

In FIG. 6, a modified embodiment of the invention is shown, where the handle 16' is integral with tool or racket 24, on the free end of said handle being threaded plug 5.

In said modified embodiment, a cylindrical air tube 15' is provided inside the hollow body composing the handle 16', said cylindrical air tube 15' having one end closed and the other end equipped with an external raised edge 18 suitable to enable the anchorage to the open end of the handle 16'.

Figure 10:
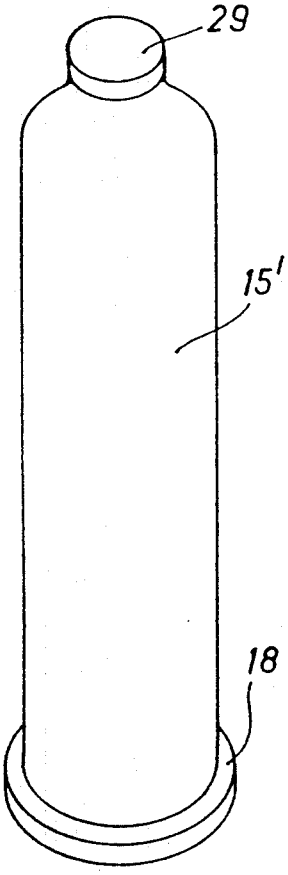
FIG. 10 is a perspective view of the air tube according to a modified embodiment from FIG. 4.

With reference to FIG. 10, the air tube 15' is furthermore equipped, at its closed end, with a cylindrical extension 29 suitable to be inserted into a seat 25 on the bottom of the hollow body of tool 24, said extension 29 being internally shaped to receive an end of the balancing bar 12 when assembled.

On the stabilizing bar 12, that is hollow and externally threaded, a cylindrical balancing mass 11 is provided, that can be threaded on the bar 12 and placed at will at a desired distance from the center of gravity of tool 24.

Figure 11:
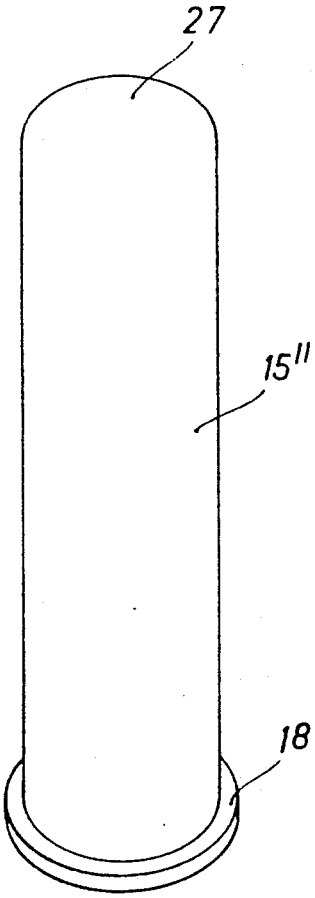
FIG. 11 is a perspective view of the air tube according to a modified embodiment from FIG. 4 and FIG. 10.
Figure 12:
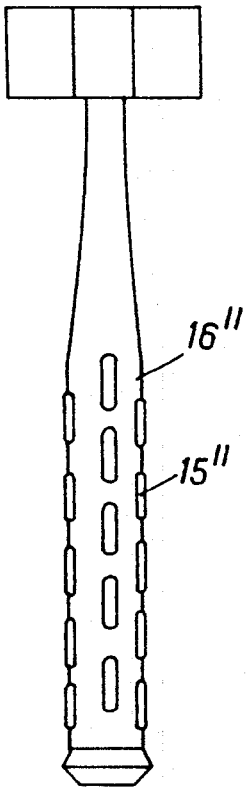
FIG. 12 is a plan view of a hammer on which the handle is assembled.

In FIG. 11, a third modified embodiment is shown, where an air tube 15'' is equipped with a dome closed end 27.

Figure 8:
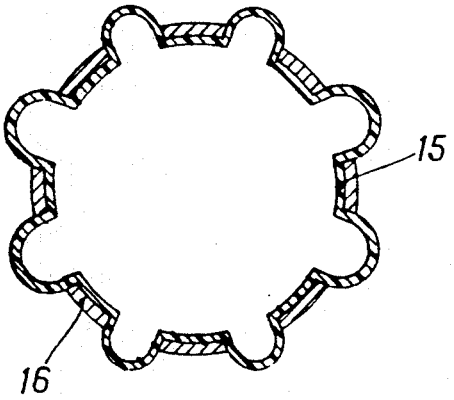
FIG. 8 is a transverse section of the handle according to the embodiment.
Figure 9:
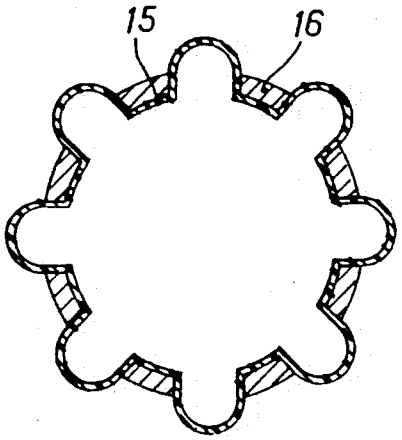
FIG. 9 is a transverse section of the handle according to a modified embodiment.

As shown in FIG. 8 and 9, openings 10 in the handle 16 can be have different shapes and dimensions, enabling different (FIG. 8) or equal size (FIG. 9) protruding pads capable to be formed when the air tube 15 is pressurized.

The air tube surface can furthermore be equipped with reliefs or knurls in order to increase grip of the pads protruding from the openings with the user's hand.

Between air tube 15; 15'; 15'' and hollow cylinder 16; 16'; 16'' a membrane or an interchangeable band can be interposed, like the one commonly used in tennis and known as a "grip", made of suitable material having a surface suitable for the applications to which the handle is destined and with anti-mildew or antiseptic or scenting properties, etc.

I claim:

1. A handle for an object such as a tool or racket, comprising:

a hollow element defining a plurality of openings extending through a wall of the hollow element; and, an air tube disposed within the hollow element, the air tube being inflatable through a valve which is accessible from outside the hollow element, portions of the air tube protruding through the openings due to internal pressure in the air tube, the protruding portions defining a plurality of pads on the handle.

2. A handle according to claim 1, further comprising plugs attached to opposite ends of the hollow element, the plugs sealingly closing opposite ends of the air tube, one of the plugs having threads suitable for threaded attachment to the object.

3. A handle according to claim 2, wherein the air tube comprises a cylindrical elastic membrane, and wherein the opposite ends of the air tube define external raised edges dimensioned to be engaged between the opposite ends of the hollow element and the plugs.

4. A handle according to claim 2, wherein the valve is disposed in one of the plugs, the valve being covered by a cap that attaches to the one of the plugs.

5. A handle according to claim 4, further comprising a balancing bar defining external threads disposed inside the hollow element, and a mass which is threadedly engaged with the balancing bar so as to be movable along the balancing bar, the balancing bar having at least one which is attached to one of the plugs.

6. A handle according to claim 2, further comprising a balancing bar defining external threads disposed inside the hollow element, and a mass which is threadedly engaged with the balancing bar so as to be movable along the balancing bar, the balancing bar having at least one end which is attached to one of the plugs.

7. A handle according to claim 2, further comprising sealing rings disposed between the opposite ends of the air tube and the plugs.

8. A handle according to claim 1, wherein the hollow element is integral with the object, and further comprising a plug attached to an end of the hollow element, the plug sealingly closing an end of the air tube.

9. A handle according to claim 8, wherein the air tube comprises a cylindrical elastic membrane having a closed end and an open end, the open end defining an external raised edge dimensioned to be engaged between the end of the hollow element and the plug.

10. A handle according to claim 9, wherein the closed end of the elastic membrane defines an extension which is externally dimensioned to be received in a seat defined in the object.

11. A handle according to claim 10, further comprising a balancing bar defining external threads disposed inside the hollow element, and a mass which is threadedly engaged with the balancing bar so as to be movable along the balancing bar, the balancing bar having an end which is attached to the plug.

12. A handle according to claim 8, wherein the valve is disposed in one of the plugs, the valve being covered by a cap that attaches to said one of the plugs.

13. A handle according to claim 8, further comprising a balancing bar defining external threads disposed inside the hollow element, and a mass which is threadedly engaged with the balancing bar so as to be movable along the balancing bar, the balancing bar having an end which is attached to the plug.

14. A handle according to claim 8, further comprising a sealing ring disposed between the end of the air tube and the plug.

15. A handle according to claim 1, wherein an external surface of the air tube defines reliefs which improve engagement between the pads protruding from the openings and a user's hand.

16. A handle according to claim 1, wherein an interchangeable band is interposed between the air tube and the hollow element, the interchangeable band providing at least one of anti-mildew, antiseptic and scenting properties.

17. A handle according to claim 1, wherein the openings are equally dimensioned.

18. A handle according to claim 17, wherein the openings define a regular array.

19. A handle according to claim 17, wherein the openings define an irregular array.

20. A handle according to claim 17, wherein at least two of the openings are dimensioned differently than one another.

21. A handle according to claim 20, wherein the openings define a regular array.

22. A handle according to claim 20, wherein the openings define an irregular array.

* * * * *